US008844313B2

(12) United States Patent
DeVos

(10) Patent No.: US 8,844,313 B2
(45) Date of Patent: Sep. 30, 2014

(54) ICE MAKING ASSEMBLY WITH BIMETALLIC ACTUATING ELEMENT AND REFRIGERATION APPLIANCE INCORPORATING SAME

(75) Inventor: Richard DeVos, Goshen, KY (US)

(73) Assignee: General Electric Company, Schenectady, NY (US)

( * ) Notice: Subject to any disclaimer, the term of this patent is extended or adjusted under 35 U.S.C. 154(b) by 353 days.

(21) Appl. No.: 13/114,743

(22) Filed: May 24, 2011

(65) Prior Publication Data

US 2012/0297815 A1 Nov. 29, 2012

(51) Int. Cl.

| | |
|---|---|
| ***F25C 5/06*** | (2006.01) |
| ***F25C 5/08*** | (2006.01) |
| ***F25C 1/14*** | (2006.01) |

(52) U.S. Cl.

CPC .... *F25C 5/06* (2013.01); *F25C 5/08* (2013.01)
USPC ..... 62/351; 62/354; 62/72

(58) Field of Classification Search

USPC ..... 62/71, 72, 73, 340, 351, 353, 354, 381; 165/109.1

See application file for complete search history.

(56) References Cited

U.S. PATENT DOCUMENTS

| | | | | |
|---|---|---|---|---|
| 2,941,377 | A * | 6/1960 | Nelson | 62/73 |
| 2,941,379 | A * | 6/1960 | Nelson | 62/135 |
| 3,654,772 | A * | 4/1972 | Curry, III | 62/353 |
| 4,649,854 | A * | 3/1987 | Janke et al. | 116/216 |
| 5,240,142 | A * | 8/1993 | Reid | 221/129 |
| 5,408,844 | A * | 4/1995 | Stokes | 62/351 |
| 6,895,767 | B2 | 5/2005 | Hu | |
| 2002/0053210 | A1 * | 5/2002 | Koster | 62/3.63 |
| 2007/0151282 | A1 * | 7/2007 | Jeong et al. | 62/349 |

FOREIGN PATENT DOCUMENTS

| | | |
|---|---|---|
| EP | 1392789 | 3/2004 |
| GB | 1045135 | 10/1966 |

* cited by examiner

*Primary Examiner* — Mohammad M Ali
*Assistant Examiner* — Christopher R Zerphey
(74) *Attorney, Agent, or Firm* — Dority & Manning, P.A.

(57) ABSTRACT

An ice making assembly includes an ice maker including a mold body defining a one or more compartments for forming ice cubes therein, a harvesting assembly removes an ice cube from the compartment, and one or more bimetallic elements. Each bimetallic element is configured with a respective one of the compartments so that when energized the bimetallic element deforms with a portion moving in a direction so as to assist in removing an ice cube from the compartment. Related refrigeration appliances are also disclosed.

20 Claims, 7 Drawing Sheets

ICE MAKING ASSEMBLY WITH BIMETALLIC ACTUATING ELEMENT AND REFRIGERATION APPLIANCE INCORPORATING SAME

FIELD OF THE INVENTION

The subject matter disclosed herein is related generally to ice making assemblies having bimetallic actuating elements and related refrigeration appliances.

BACKGROUND OF THE INVENTION

In a refrigeration appliance such as a refrigerator or freezer, several systems have been proposed for cooling of an ice maker within the refrigerator or freezer cabinet. In some systems, the ambient air within a freezer is chilled to a temperature low enough to form the ice. In other systems, known as directly cooled systems, a cooling loop for the ice maker is added to typical the refrigeration loop. The ice maker cooling loop can be routed through the mold body of the ice maker, thereby directly cooling the ice maker to increase the rate at which ice can be formed in the ice maker.

Often, a heating device of some sort is provided to help remove ice cubes from the mold compartments in which they are formed. An electrical strip heater can be used beneath the mold for example to heat the mold generally, thereby slightly melting the ice cubes and allowing them to be removed by arms of a harvester. In some devices, warm refrigerant can also be passed through the ice maker mold when ice cubes are ready for harvest to melt the cubes slightly.

However, applying enough heat to fully melt the surface of an ice cube to allow it to be removed from the mold compartment requires a given amount of energy for the heating. Heating ice cubes causing such melting is in some ways inherently inefficient (energy needed to freeze; then more energy needed to melt). Also, regardless of energy issues, slightly melted ice cubes may refreeze in undesirable ways in the cold environment, for example sticking to the ice maker or ice cube bucket, or to each other in the ice maker or ice cube bucket causing clogs. Accordingly, an alternate system of removing ice cubes from compartments in the ice cube mold, addressing one or more of the above issues or others would be welcome.

BRIEF DESCRIPTION OF THE INVENTION

Aspects and advantages of the invention will be set forth in part in the following description, or may be obvious from the description, or may be learned through practice of the invention.

According to certain aspects of the disclosure, an ice making assembly includes an ice maker including a mold body defining a one or more compartments for forming ice cubes therein, a harvesting assembly removes an ice cube from the compartment, and one or more bimetallic elements. Each bimetallic element is configured with a respective one of the compartments so that when energized the bimetallic element deforms with a portion moving in a direction so as to assist in removing an ice cube from the compartment. Various options and modifications are possible.

According to certain other aspects of the disclosure, a refrigeration appliance includes a refrigerated cabinet, an ice maker within an interior of the refrigerated cabinet including a mold body defining a one or more compartments for forming ice cubes therein, a harvesting assembly removes an ice cube from the compartment, and one or more bimetallic elements. Each bimetallic element is configured with a respective one of the compartments so that when energized the bimetallic element deforms with a portion moving in a direction so as to assist in removing an ice cube from the compartment. Again, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
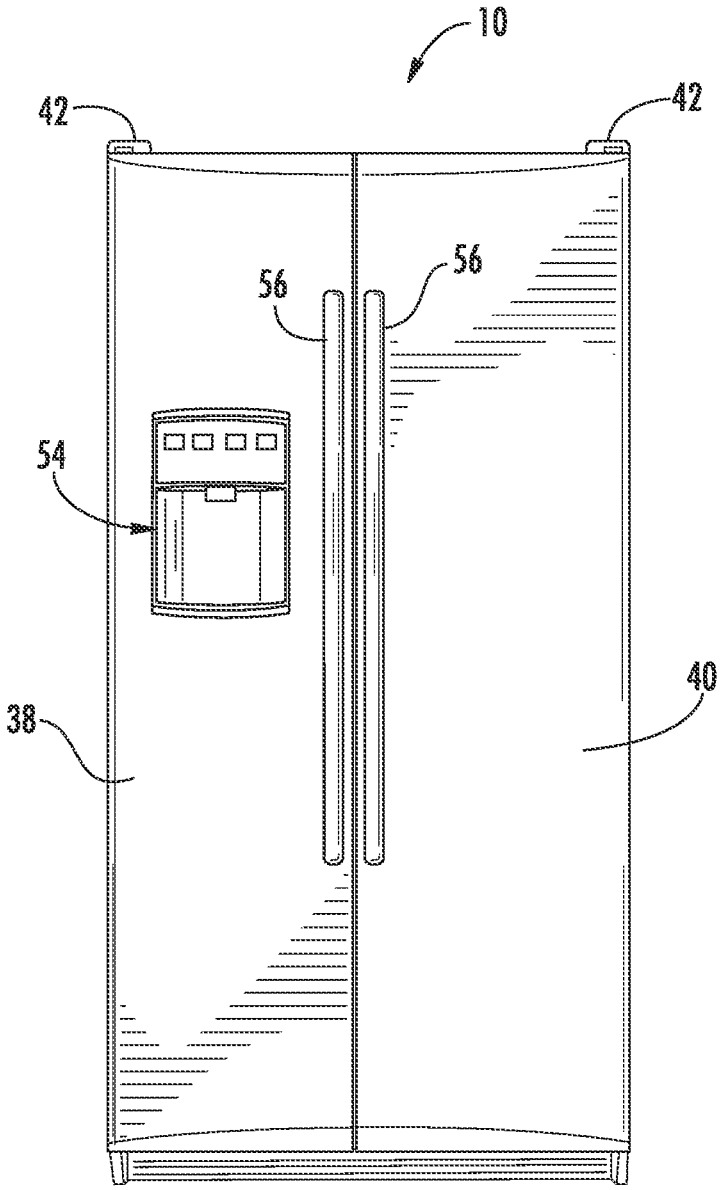
FIG. 1 provides a front view of a refrigeration appliance with its doors closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of an exemplary refrigeration appliance 10 depicted as a refrigerator in which ice-making assemblies in accordance with aspects of the present invention may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth.

Figure 2:
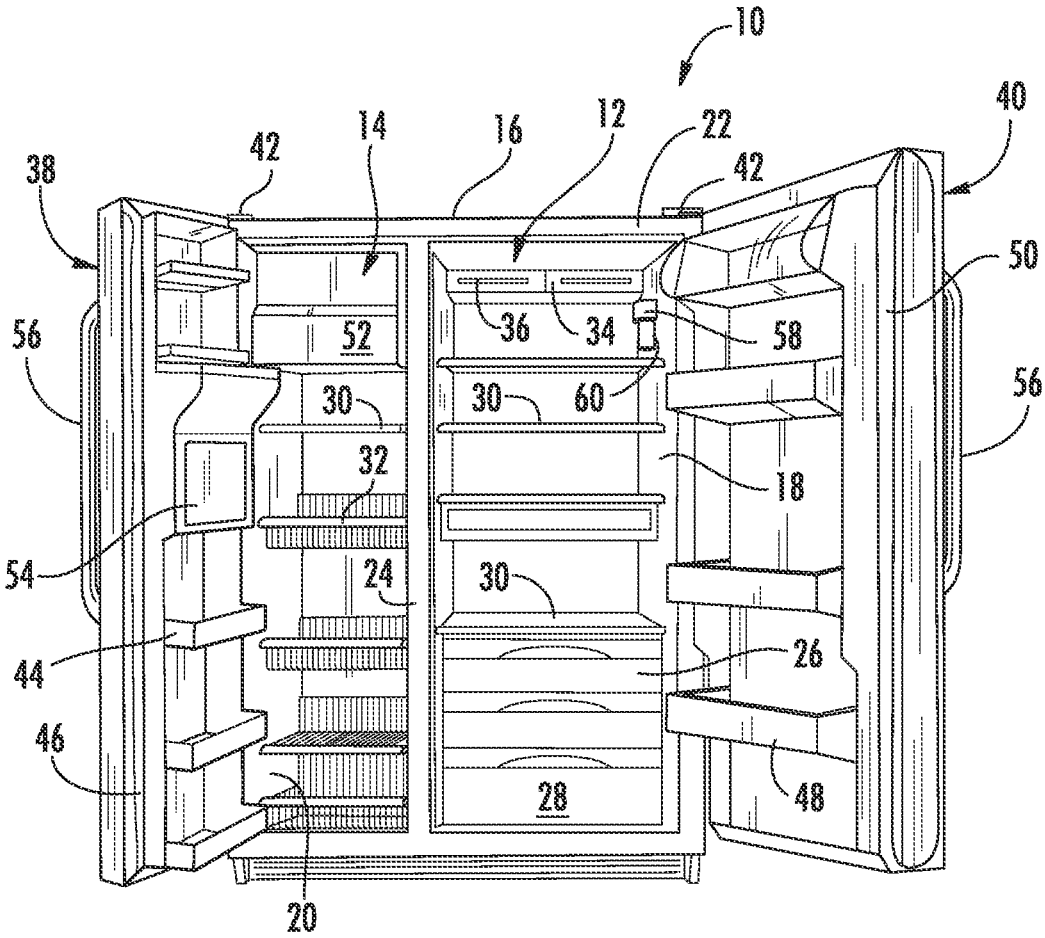
FIG. 2 provides a front view of the refrigeration appliance of FIG. 1 with its doors opened.

Referring to FIG. 2, the refrigeration appliance 10 includes a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Slide-out drawers 26, a storage bin 28 and shelves 30 are normally provided in fresh food storage compartment 12 to support items being stored therein. In addition, at least one shelf 30 and at least one wire basket 32 are also provided in freezer storage compartment 14.

The refrigerator features are controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between an open position, as shown in FIG. 1, and a closed position. The freezer door 38 may include a plurality of storage shelves 44 and a sealing gasket 46, and fresh food door 40 also includes a plurality of storage shelves 48 and a sealing gasket 50.

The freezer storage compartment 14 may include an automatic ice maker 52 and a dispenser 54 provided in the freezer door 38 such that ice and/or chilled water can be dispensed without opening the freezer door 38, as is well known in the art. Doors 38 and 40 may be opened by handles 56 is conventional. A housing 58 may hold a water filter 60 used to filter water for the ice maker 52 and/or dispenser 54.

As with known refrigerators, the refrigeration appliance 10 also includes a machinery compartment (not shown) that at least partially contains components for executing a known vapor compression cycle for cooling air. The components include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to directly cool the ice maker to form ice cubes, and a heating loop can be added to help remove ice from the ice maker, as discussed below. Collectively, the vapor compression cycle components in a refrigeration circuit, associated fans, and associated compartments are conventionally referred to as a sealed system. The construction and operation of the sealed system are well known to those skilled in the art.

Figure 3:
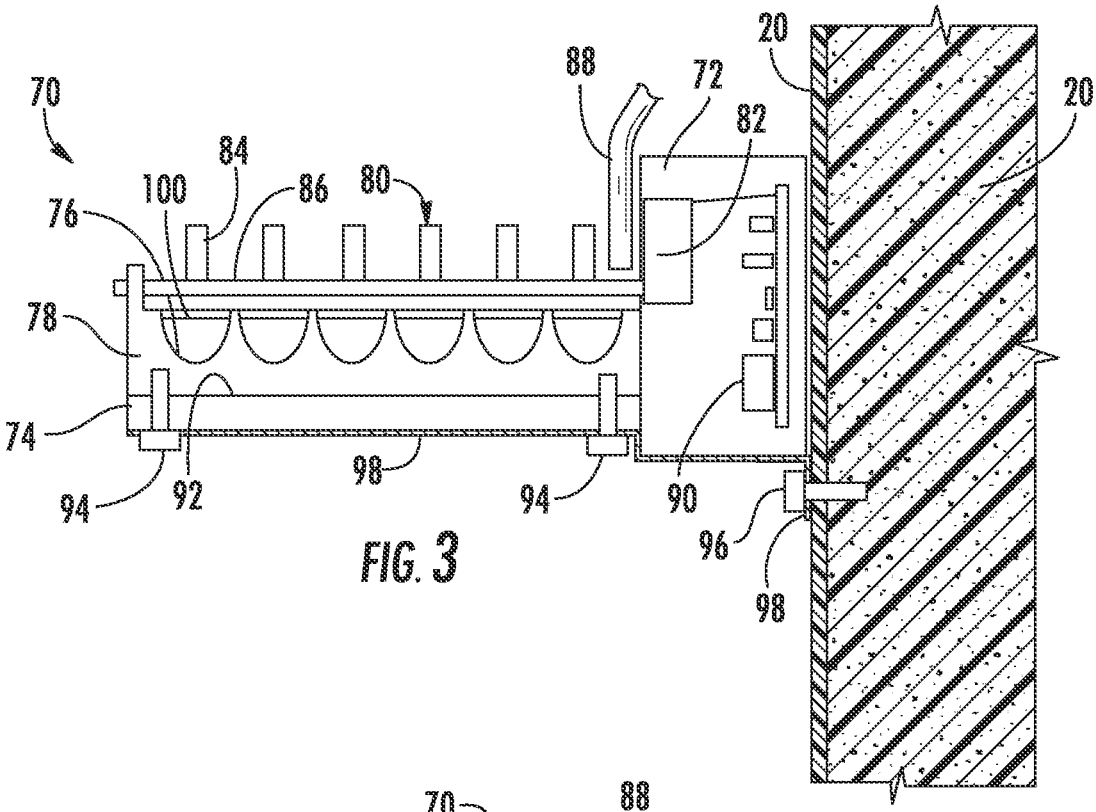
FIG. 3 provides a schematic side view of one ice making assembly in a refrigeration appliance according to certain aspects of the present disclosure.

As shown in FIG. 3, ice maker assembly 70 includes an ice maker 72 mounted on a plate 74. Plate 74 may be a directly cooled plate for chilling water in compartments 76 of mold body 78, or simply a bottom part of the mold body/ice maker assembly. Ice maker assembly 70 can be mounted as shown to inner liner wall 20 of freezer compartment 14 backed by insulation 73, although it could be mounted in other locations in any refrigerated compartment. Ice maker 72 makes a number of ice cubes 100 at a time automatically from a water source. Ice maker 72 may therefore make 6-8 cubes per cycle, and over 100 ice cubes per day, for example, in ice cube mold compartments 76 formed within mold body 78.

Ice cubes 100 are dumped periodically into an ice bucket assembly (not shown) in a conventional fashion, for example by virtue of an ice harvesting assembly. In FIG. 3, harvesting assembly includes a harvester 80 wherein relative rotation between the harvester 80 and mold body 78/compartments 76 extracts ice cubes 100. As shown, harvester 80 includes a motor 82 for moving rod 86 and tines 84 relative to the compartments 76.

However, it should be recognized that the moving portion and fixed portion could be reversed. That is, mold body 78 and compartments 76 may be moved by a motor relative to a fixed harvester 80. Or, both could be moved. Also, the rod and tines could also be replaced by other structures, shafts, threaded members, etc. Therefore, relative rotation of some sort can be achieved to assist in removing ice cubes 100 from compartments 76. Also, an alternate harvesting assembly without a rod/tine harvester is described below with reference to FIGS. 10-12.

Ice maker 72 also includes a water source 88 for filling compartments 76 once emptied. Ice maker 72 may be connected to a controller 90, which may be a dedicated controller or which may comprise controller 34 mentioned above.

If plate 74 is a cooling plate, it may be made of a substance that readily transmits thermal energy. For example, cooling plate 74 may be a metal such as aluminum with a large area of contact 92 with mold body 78 so as to maximize heat transfer from the mold body to the cooling plate to make ice.

Figure 4:
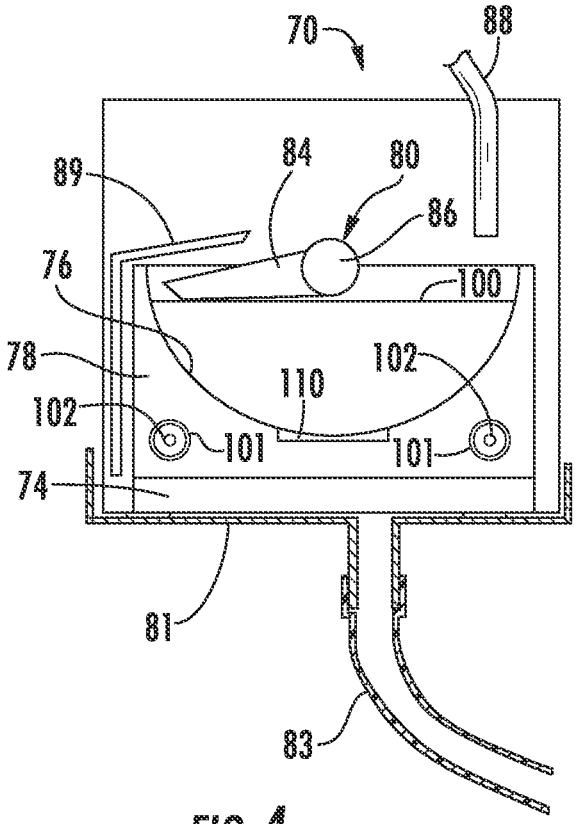
FIG. 4 provides a schematic end view of the ice making assembly of FIG. 3.

Plate 74 may be removably attached to ice maker 72 with fasteners 94 such as screws. Plate 74 may also be mounted to a surface such as inner liner wall 20 with additional fasteners 96 and a bracket 98, although the plate could be attached to the inside of the refrigerated compartment in various ways, either removably or permanently. As shown in FIG. 4 (not in FIG. 3, for clarity), a drain pan 81 and drain tube 83 may be employed in case of condensation or melting from ice maker 72, for example from ice cube harvesting or defrosting.

Plate 74 may have an optional heat exchange tube 101 within it (see FIG. 4) to provide heating or cooling to the plate and in turn mold body 78 to form ice or to help harvest ice cubes 100, respectively. Therefore, tube 101 can be a portion of the vapor compression refrigerant cycle, as described below, carrying refrigerant at a temperature lower than the mold body 78 to draw heat from the mold body to make ice. Tube 101 may also carry warmer refrigerant in some situations to provide a short heating of the mold body 78 to assist in removing ice cubes 100 once formed from individual mold compartments 76 if desired. Tube 101 can also carry an electrical resistance heating strip 102 within it, whether plate is directly cooled or not, for assisting in removal of ice cubes. Heating strip 102 can have various other orientations and locations within or adjacent plate 74, if desired. Alternatively (not shown), one tube for cold refrigerant and another for warm refrigerant could be provided through plate 74. It should therefore be understood that the present disclosure is not limited to any type of ice maker, whether environmentally cooled or directly cooled.

Figure 5:
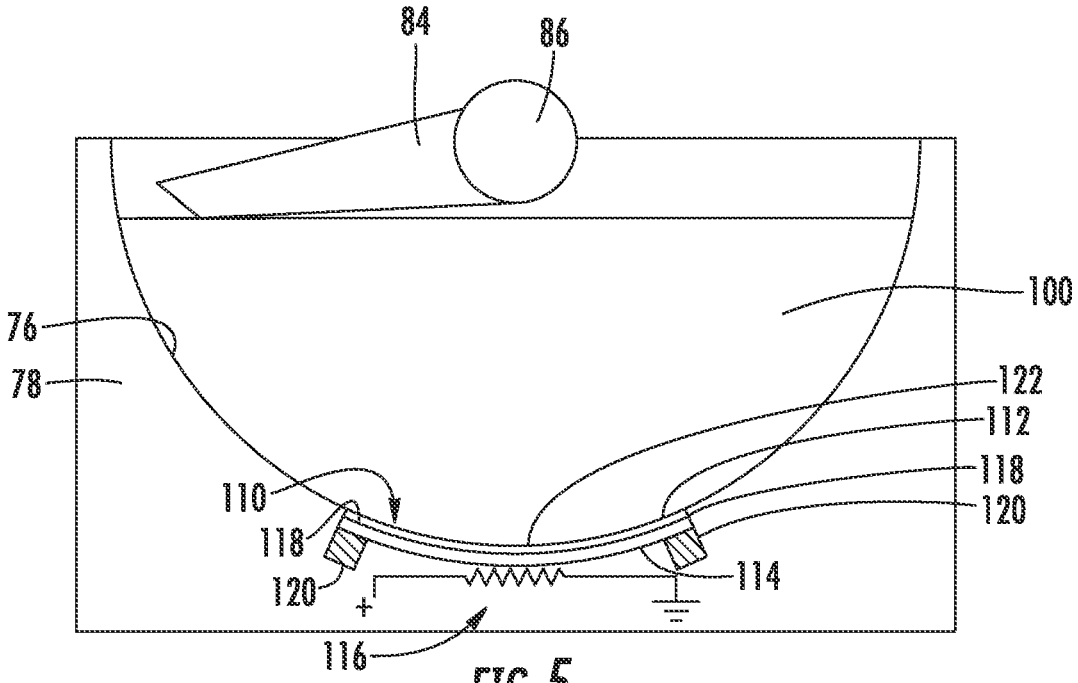
FIG. 5 provides a schematic side close up view of an ice making cavity showing a bimetallic strip in an unactuated state.
Figure 6:
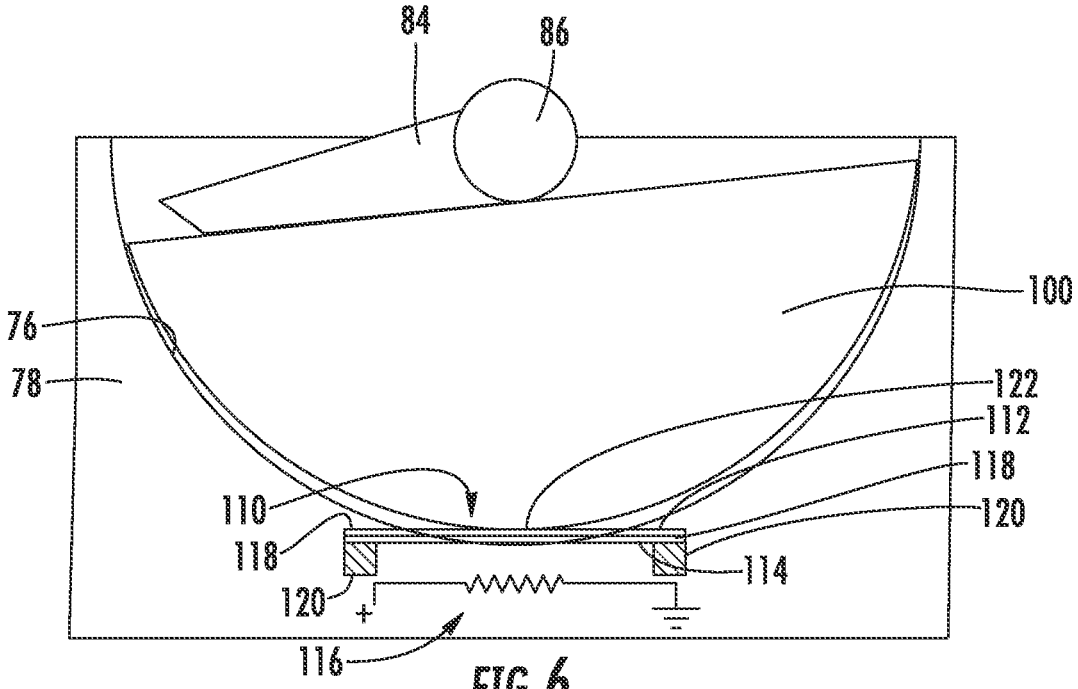
FIG. 6 provides a schematic side close up view of an ice making cavity showing a bimetallic strip in one actuated state.

FIGS. 5 and 6 show a close up diagrammatical view of one ice cube compartment 76 within mold body 78. As shown, bimetallic element is provided in the form of a strip 110 comprising two metal portions 112,114 is located along an edge of compartment 76. Element 110 could have various shapes other than a strips, as shown, so no limitation as to shape should be implied by use of the term "element." Element 110 could be made of various combinations of metals such as copper and steel, brass and steel, etc. A non-stick coating such as Teflon could be applied to bimetallic element 110 to prevent the ice cubes from sticking to it. Bimetallic element 110 can be oriented with the metal that undergoes greater elongation when energized in contact with compartment 76 or ice cube 100.

A source of electrical heating 116 is schematically shown within mold body 78. Heat source 116 may be elements 102 used to heat mold body and melt ice cube 100, or heat source may be a separate smaller heat source dedicated to element 110 either as a supplement to or substitution for elements 102. Using a separate heat source 116 may allow for a lower total energy usage for ice cube harvesting and/or less undesired refreezing, as mentioned above, as either less or no melting of the ice cubes is required for removal from compartments 76.

FIG. 5 shows ice cube 100 before activation of heat source 116 so that bimetallic element 110 is not deformed into compartment 76. FIG. 6 shows ice cube 100 after bimetallic element 110 has deformed due to activation of heat source 116. In this embodiment, ends 118 of the depicted strip 110 are fixed at points 120 to mold body 78, and a center portion 122 raises upward to lift ice cube 100 slightly within compartment 76 when heat source 116 is activated.

Figure 7:
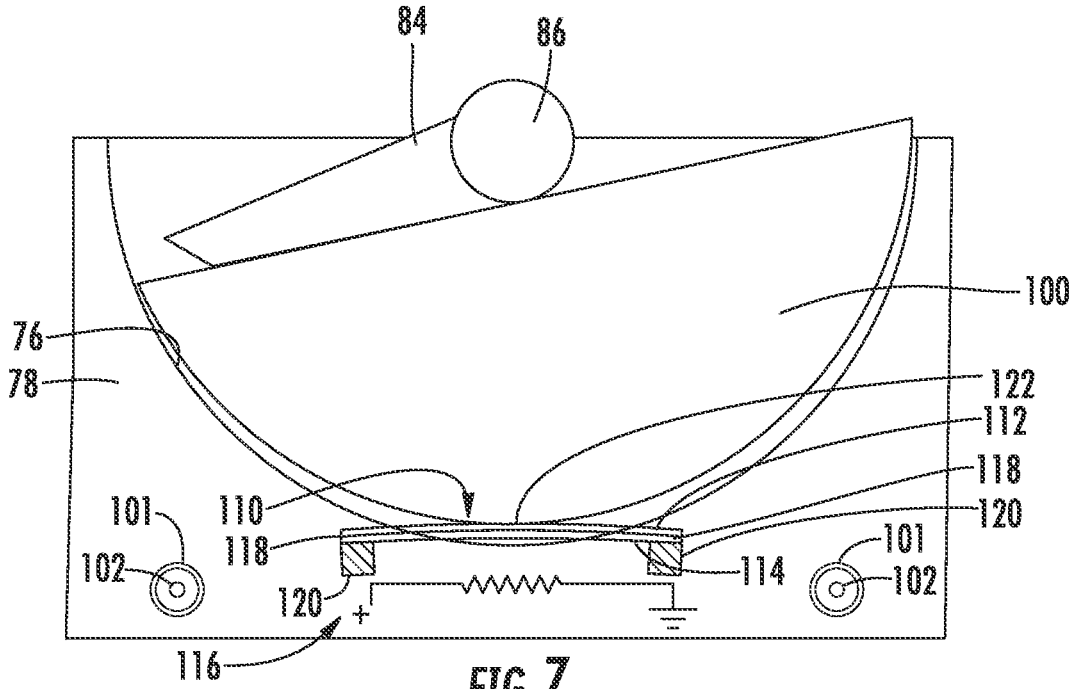
FIG. 7 provides a schematic side close up view of an ice making cavity showing an alternate bimetallic strip heating structure in an actuated state.

FIG. 7 shows a modified structure, wherein a bimetallic element 110 is heated by one or both of two different structures. First, heating source 116 as shown includes a direct electrical connection to bimetallic element 110. Also, instead of or in addition to using a dedicated heating source for bimetallic element 110, the bimetallic element can be heated by refrigerant tubes 101 and/or strips 102 used to heat mold body 78 for ice harvesting. Upon heating by any of such elements, bimetallic element 110 still provides an upward lift to ice cube 100, as above.

Figure 8:
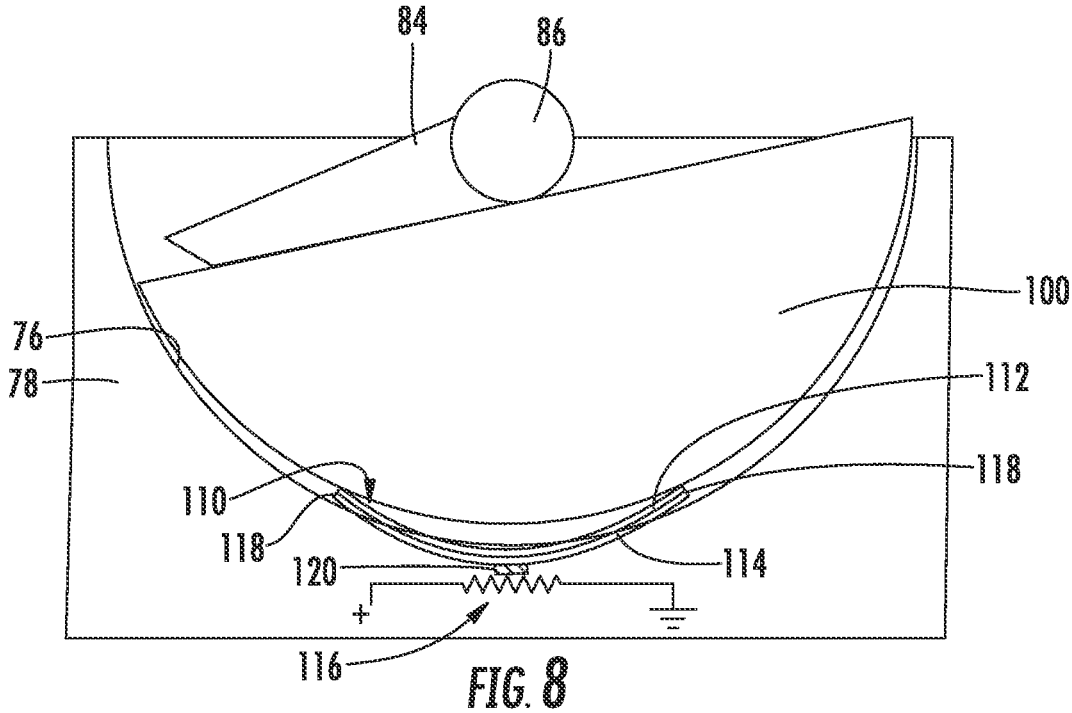
FIG. 8 provides a schematic side close up view of an ice making cavity showing another alternate bimetallic strip in an actuated state.

FIG. 8 shows a bimetallic element in the form of a strip 110 similar to that of FIG. 4, but attached in a different way. As shown, bimetallic element 110 is fixed in place at one or more central points 120. When activated, ends 118 move upward to assist in harvesting of ice cube 100. Various other orientations and points of fixture could be employed.

Figure 9:
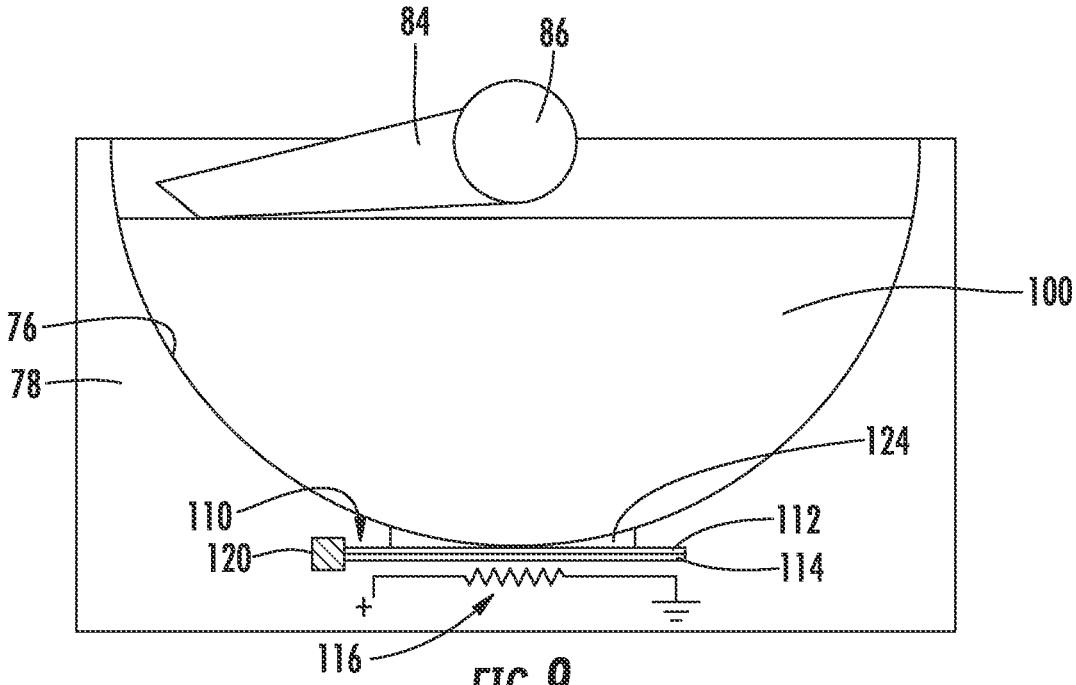
FIG. 9 provides a schematic side close up view of an ice making cavity showing yet another alternate bimetallic strip in an unactuated state.

As shown in FIG. 9, bimetallic element 110 is mounted in a cantilevered fashion at point 120. Also, a contact element 124 for lifting ice cube 100 is provided atop bimetallic element 110. Therefore, unlike in the previous embodiments, in the embodiment of FIG. 9 bimetallic element 110 does not contact ice cube 100 directly.

Figure 10:
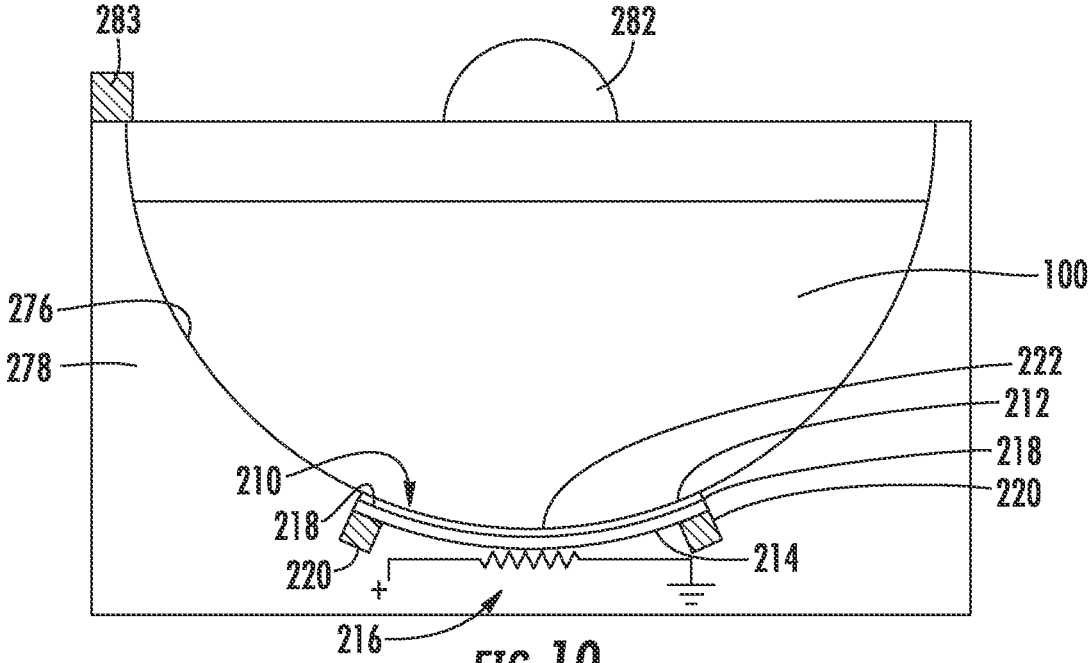
FIG. 10 provides a schematic side view of an alternate ice making assembly with a bimetallic strip in an unactuated state.
Figure 11:
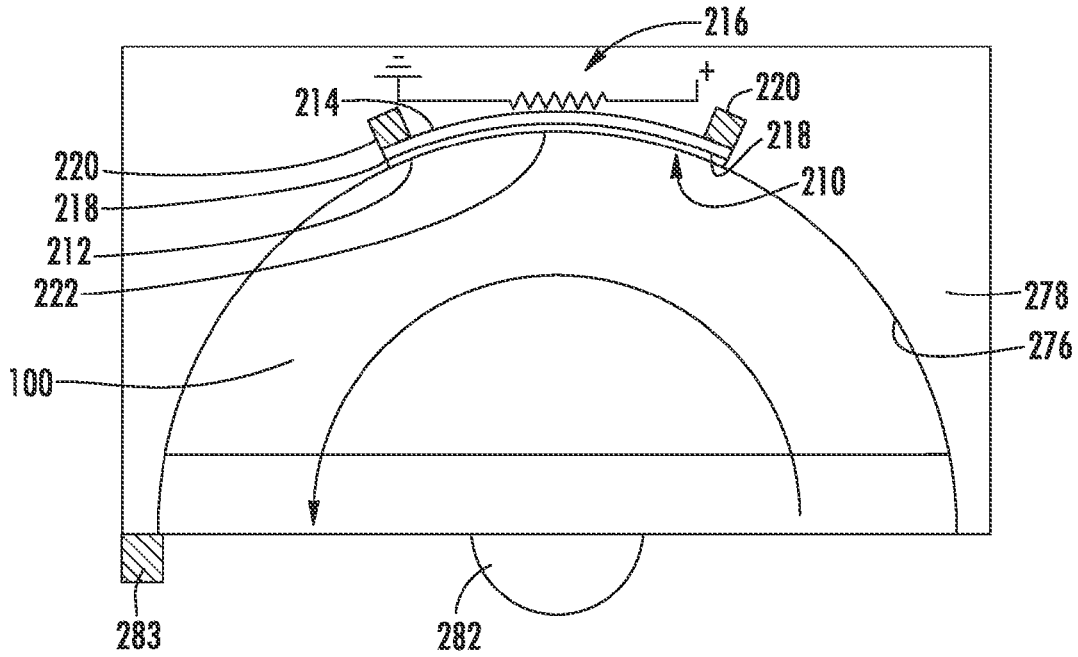
FIG. 11 provides a schematic side view of the assembly of FIG. 10 with the mold in an inverted state.
Figure 12:
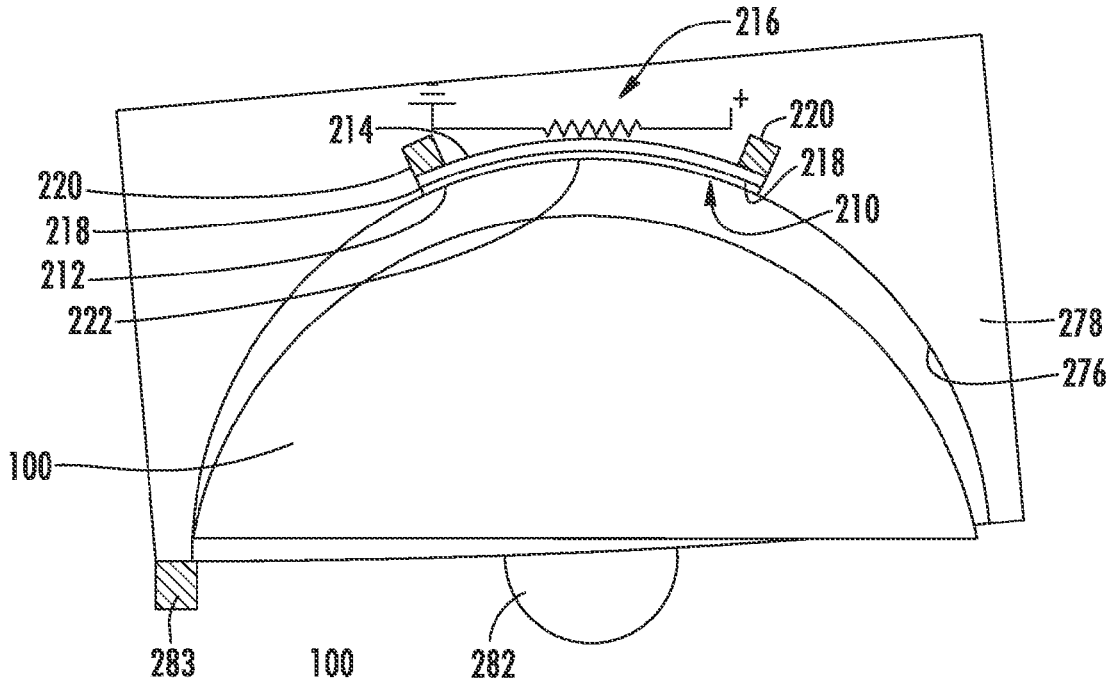
FIG. 12 provides a schematic side view of the assembly of FIG. 10 with the mold in an inverted and deformed state.

FIG. 10 shows an alternate embodiment in which mold body 278 is rotatable via motor 282 to invert the mold body (FIG. 11) for dumping ice. Before, during, or after such inversion, bimetallic element 210 can be activated to assist in removing the ice cubes 100. If desired, mold body 278 may be made of deformable material, so that a bending, twisting, etc. may be applied by motor 282, appropriate stops 283, etc., to assist in removing ice cubes (FIG. 12). The bending may be applied before, during or after activation of bimetallic element 210. Bimetallic element 210 may include any of the arrangements, shapes, options, etc., described herein. Therefore, the harvesting assembly of this embodiment includes the motor and structure for inverting the mold body, and may also include the optional materials for allowing the bending of the mold body. No movable rod or tines need move through compartments 176, as above.

In view of the above, it should be clear that it is possible to have alternate shapes and orientations for element 110/210, points 120, contact element 124, etc. Bimetallic element 110/210 could be rectangular, circular, rounded, or any other shape. Also, element 110/210 could be coextensive with the surface of compartment 76/276, recessed, extended, etc. Element 110/210 can be mounted to mold body 78/278 by one or more points at ends, centrally, cantilevered, or any other fashion. Element 110/210 need only provide some sort of force assist to remove ice cube 100. Element 110/210 could therefore be used in combination with various mechanical linkages, plungers, hinges, cantilevers, spring elements, etc., as desired. Although element 110/210 has been shown in described at times as a strip herein, various other shapes and orientations are possible. Further, other locations within compartment 76/276 are possible, and more than one discrete element 110/210, either separate or linked, could be employed.

Accordingly, various options and modifications to the above structures can be employed, and combinations of features of the above bimetallic element and its related structures, heating source, mold bodies, etc. can be envisioned in view of the present disclosure. An ice maker with a bimetallic element for assisting in ice harvesting can be practiced in many ways. The ice maker and element may therefore be useful in more readily removing ice for harvest, preventing refreezing of ice cubes together, and/or preventing ice cubes from freezing to the ice maker itself or other cold surfaces. Energy use may be reduced as well by eliminating or limiting the amount of melting needed to harvest the ice cubes.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly comprising:

an ice maker including a mold body defining one or more compartments for forming ice cubes therein;

a harvesting assembly for removing an ice cube from the one or more compartments;

one or more bimetallic elements, each bimetallic element positioned at a respective compartment and wherein at least a portion of each bimetallic element is configured to deform into the respective compartment when activated and create a separation between an edge of the compartment and an ice cube and assist in removing an ice cube from the respective compartment, wherein each of the one or more bimetallic elements is fixed in place at one or more points; and a heating source located at the one or more compartments in the ice maker and configured to activate the one or more bimetallic elements by heating.

2. The ice making assembly of claim 1, wherein the heating source is located within the mold body.

3. The ice making assembly of claim 1, wherein the heating source is in direct electrical communication with the one or more bimetallic elements.

4. The ice making assembly of claim 1, wherein each bimetallic element contacts the ice cube directly.

5. The ice making assembly of claim 1, wherein each bimetallic element moves an ice lifting element.

6. The ice making assembly of claim 1, wherein each bimetallic element includes a non-stick coating.

7. The ice making assembly of claim 1, wherein the harvesting assembly includes one or more tines attached to a rotatable rod, the tines movable through the compartments to remove the ice cubes.

8. The ice making assembly of claim 1, wherein the harvesting assembly includes a harvesting mechanism for inverting a mold body holding the one or more compartments, the ice cubes falling out of the compartments after the mold body is inverted.

9. The ice making assembly of claim 8, wherein the harvesting mechanism bends the mold body after it is inverted to assist in removing ice cubes from the compartments.

10. The ice making assembly of claim 1, wherein at least a portion of each bimetallic element is configured to deform into the respective compartment and away from the edge of the compartment when activated.

11. The ice making assembly of claim 1, wherein each bimetallic element is located along the edge of the respective compartment when not activated.

12. A refrigeration appliance comprising:

a refrigerated cabinet;

an ice maker within an interior of the refrigerated cabinet including a mold body defining compartments for forming ice cubes therein;

a harvesting assembly for removing ice cubes from the compartments;

one or more bimetallic elements, each bimetallic element positioned in the mold body at the compartments and configured to deform at least a portion of the one or more compartments when activated by heating and assist in removing the ice cubes from the respective compartments, wherein each of the one or more bimetallic elements is fixed in place at one or more points; and a heating source located at the compartments configured for conducting sufficient heat to the one or more bimetallic elements so as to cause the deformation.

13. The refrigeration appliance of claim 12, wherein the one or more bimetallic elements are each fixed in place at one or more points of attachment to the mold body.

14. The refrigeration appliance of claim 12, wherein the heating source is in direct electrical communication with the one or more bimetallic elements.

15. The refrigeration appliance of claim 12, wherein each bimetallic element moves an ice lifting element.

16. The refrigeration appliance of claim 12, wherein the harvesting assembly includes one or more tines attached to a rotatable rod.

17. The refrigeration appliance of claim 12, wherein the harvesting assembly includes a harvesting mechanism for inverting a mold body holding the one or more compartments, the ice cubes falling out of the compartments after the mold body is inverted.

18. The refrigeration appliance of claim 17, wherein the harvesting mechanism bends the mold body after it is inverted to assist in removing ice cubes from the compartments.

19. The ice making assembly of claim 1, wherein the heating source is a separate heating element dedicated to the bimetallic element.

20. The refrigeration appliance of claim 12, wherein the one or more bimetallic elements are positioned below the mold body.

* * * * *